United States Patent [19]

Whittaker

[11] Patent Number: 5,018,635

[45] Date of Patent: May 28, 1991

[54] FLUID CONTAINMENT AND ACCESS DEVICE FOR A BEVERAGE CONTAINER

[76] Inventor: Michael T. Whittaker, 29 Carrier Ct., Auburn, Me. 04210

[21] Appl. No.: 557,584

[22] Filed: Jul. 24, 1990

[51] Int. Cl.[5] ..... B65D 25/38

[52] U.S. Cl. ..... 220/90.2; 215/1 A; 215/229; 220/90.4

[58] Field of Search ..... 220/90.2, 90.4; 215/1 A, 11.5, 229

[56] References Cited

U.S. PATENT DOCUMENTS

| | | | |
|---|---|---|---|
| D. 193,362 | 8/1962 | Groff | D58/25 |
| 1,669,892 | 5/1928 | Beck | 215/11.5 |
| 2,052,307 | 8/1936 | Kennedy | 215/229 |
| 2,052,496 | 8/1936 | Stassi | 215/229 |
| 2,608,841 | 9/1952 | Rice | 215/11.5 |
| 2,710,108 | 6/1955 | Zarra | 215/1 A |
| 3,349,987 | 10/1967 | Weitznerg323 12 | 220/90.2 |
| 3,773,243 | 11/1973 | Greene | 229/7 |
| 3,822,030 | 7/1974 | Tanzer | 220/90.2 |
| 4,036,392 | 7/1977 | Martin | 220/23 |
| 4,265,363 | 5/1981 | Conn | 215/1 A |
| 4,291,814 | 9/1981 | Conn | 220/90.4 |
| 4,415,097 | 11/1983 | Meins | 220/90.4 |
| 4,579,257 | 4/1986 | Brandlein | 222/192 |
| 4,586,625 | 5/1986 | Garrett | 220/266 |
| 4,596,341 | 6/1986 | Bruffey | 220/90.4 |
| 4,607,755 | 8/1986 | Andreozzi | 220/90.4 X |
| 4,615,457 | 10/1986 | Harding | 220/90.2 |
| 4,714,173 | 12/1987 | Ruiz | 220/90.4 |
| 4,782,975 | 11/1988 | Coy | 220/90.4 |
| 4,811,860 | 3/1989 | Sorenson | 206/515 |
| 4,828,141 | 5/1989 | Coy | 220/380 |
| 4,911,315 | 3/1990 | Shrum | 215/1 A |

*Primary Examiner*—Steven M. Pollard

*Attorney, Agent, or Firm*—Fish & Richardson

[57] ABSTRACT

A fluid containment and access device for use with a beverage container having an upper, beaded rim and an opening for flow of the fluid contents from within the volume of the container includes a flexible lid, an integral straw and a vent with closure. The lid fits securely upon the top of the beverage container to form a fluid-tight seal. The straw has a first end extending above the lid and a second end that extends through the opening substantially to the bottom of the container. The vent closure is moveable between a first position to permit the flow of air into the container and a second position to prevent the flow of air into the beverage container.

5 Claims, 2 Drawing Sheets

VENT HOLE OPEN

VENT HOLE CLOSED

FLUID CONTAINMENT AND ACCESS DEVICE FOR A BEVERAGE CONTAINER

BACKGROUND OF THE INVENTION

The invention relates to covers for a beverage container.

A beverage container, e.g., a soft drink or juice can, is typically accessed by means of a removable pull tab or pop top, both of which are well known devices for providing an opening in the top of the container near the rim through which the contents of the container can flow. One obvious drawback to providing such an opening is the possibility of spilling the contents of the container because of simple carelessness or during transport, e.g., while walking or driving a car. Another drawback of such an arrangement is the difficulty encountered when a person drinks directly from the container and attempts to empty the container of the last of its contents, because the opening does not extend to the very rim of the container and forms a lip on the edge of the opening. Thus the person must tilt the container or his or her head back at an awkward and uncomfortable angle to completely drain the container of its contents. A straw may be inserted in the opening to reach the bottom of the container and thereby avoid such difficulty, but unless the straw is held in place, and particularly if the contents of the container are carbonated, the straw tends to float up and out of the container, thereby defeating its advantageous use.

SUMMARY OF THE INVENTION

According to the invention, a fluid containment and access device for use with a beverage container having an upper, beaded rim and an opening for flow of the fluid contents from within the volume of the container comprises a flexible lid sized and constructed for secure fit upon the top of the beverage container in a manner to form a fluid-tight seal thereupon; a straw integral with the lid and having a first end extending generally above the lid and a second end adapted to extend through the opening into the volume of the container, the straw being sized to extend substantially to the bottom of the beverage container; and a vent assembly mounted in the lid comprising a closure element adapted to be moved between a first position to permit the flow of air into the beverage container and a second position to prevent the flow of air into the beverage container.

Preferred embodiments of the invention may include one or more of the following features. The first end of the straw is angled at approximately 45° to the axis of the container. The container further has a lower rim defined at the intersection of the container side wall and base, and the second end of the straw is sized and constructed to engage the lower rim of the container in a region directly below the container opening. Preferably the second end of the straw comprises a middle portion disposed generally vertical to the container axis, and a lower portion angled at approximately 45° to the axis, and extending substantially to the bottom rim of the container. In first position, the closure assembly is adapted to be pulled up and away from the lid, and in second position, the closure assembly is adapted to be pushed down and towards the lid. The device further comprises a closure element for the straw, e.g. a cap.

Other advantages and features will become apparent from the following description of a presently preferred embodiment, and from the claims.

DESCRIPTION OF THE PREFERRED EMBODIMENT

Figure 4:
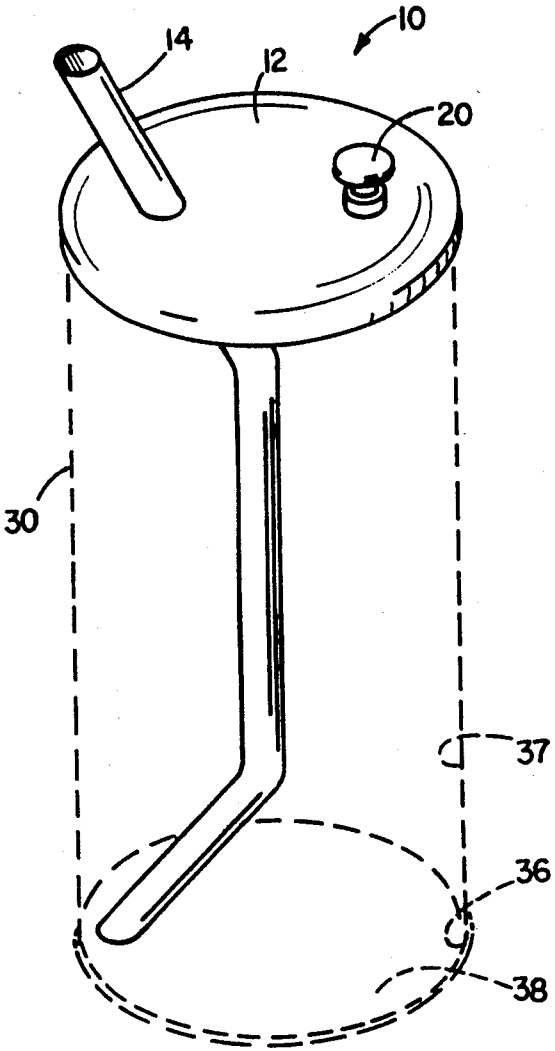
Figure 3A:
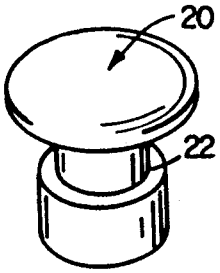
Figure 3B:
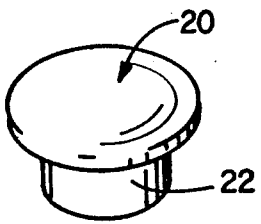

FIGS. 3*a* and 3*b* are similar views of a vent and closure assembly provided in the device of the invention, the closure assembly being shown in open and closed positions, respectively; and FIG. 4 is a perspective view of the device of the invention fitted upon a standard beverage container.

Figure 1:
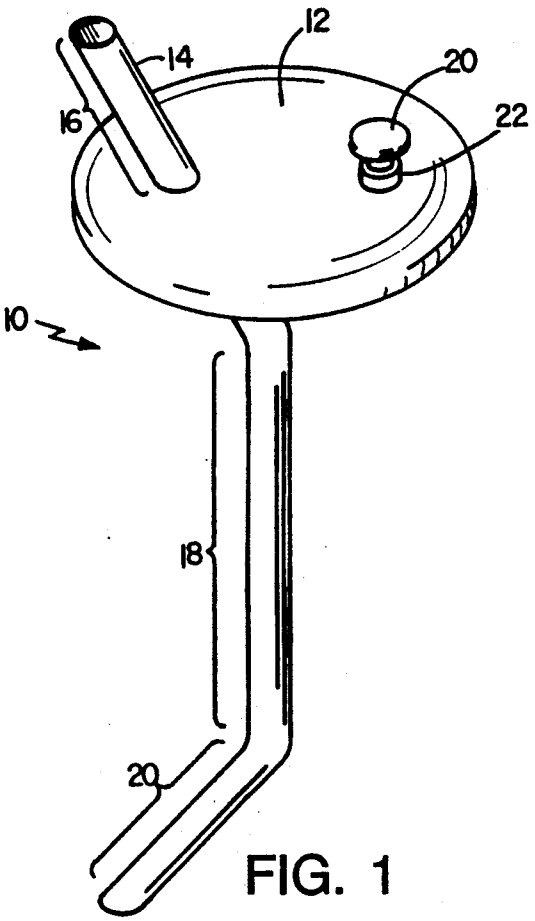
FIG. 1 is perspective view of a device according to the present invention for use with a beverage container.
Figure 2:
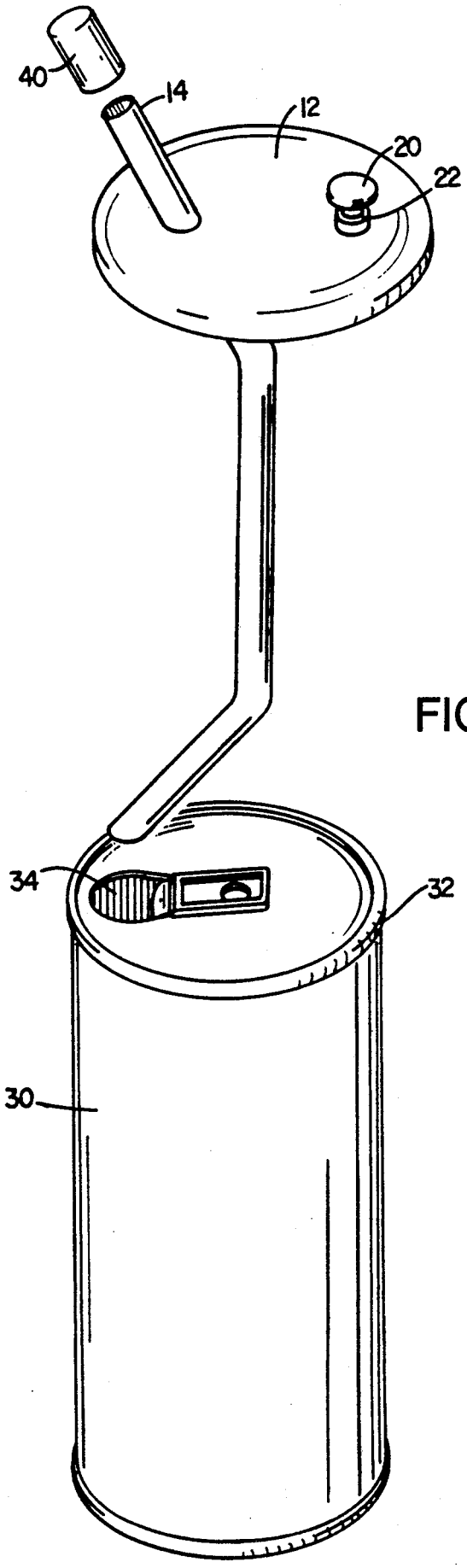
FIG. 2 is a similar view of the device of the invention and a standard beverage container.

Referring to FIG. 1, a device 10 of the invention is a one piece unit consisting of a cover element or lid 12 sized and constructed to fit snugly upon the top of a standard sized beverage container, e.g., a soft drink or juice can, and an integral straw 14. A suitable container 30 (shown in FIG. 2) has a beaded upper rim 32 at one end with an opening 34, e.g., formed by a pull tab or pop top of standard design (not shown), through which the contents of the container 30 can flow. The lid 12, preferably made of a soft, flexible plastic, has a diameter slightly exceeding the diameter of the container 30 and a downwardly extending annular flange 13 sized to snap in place over the beaded upper rim 32 of the container 30. When fitted over the container 30, the lid 12 provides a water tight seal around the edges of the container 30, thus to effectively eliminate the cause of a majority of accidental spills.

The straw 14 is joined to the lid 12, e.g. the straw and lid may be molded as an integral parts of the device 10. The straw 14 has an upper portion 16, a middle portion 18 and a lower portion 20. The upper portion 16 extends above (and slightly below) the lid 12 at an angle of approximately 45° to the normally vertical axis of the beverage container. The middle portion 18 extends parallel to the container axis, and perpendicular to the surface of the lid 12, within the container, and the lower portion 20 is angled at approximately 45° to the middle portion, towards the lower rim 36 at the intersection of the side wall 37 and base 38 of the container, generally below the container opening. The straw 14 is thus fixed in place and can not float out of the container. The upper portion 16 of the straw is angled conveniently for a person to use the straw 14 to drink from the container, while the middle portion 18 and lower portion 20 are angled to allow the person to easily insert the straw through the opening in the container. Finally, the lower portion 20 is disposed to engage the lower rim of the container (at the intersection of the side wall and the base) so that the last contents of the container are easily drained (as illustrated in FIG. 4).

The device 10 of the invention also includes a vent 22, e.g., molded as a part of the lid 12. The vent has a closure device 24 (shown in detail in FIGS. 3*a* and 3*b*) which may be moved between a first position pulled up and away from the lid 12 to permit the flow of air into the container 30 and prevent the formation of a vacuum within the container when the contents are being removed via the straw 14 (FIG. 3*a*), and a second position with the closure device 24 pushed down and towards the lid 12 to prevent the flow of air into the container 30 and seal the container (FIG. 3*b*). Thus, in the case of containers having non-carbonated beverages as contents, when the cover 12 is securely fitted over the rim 34 of the container 30 and the closure device 22 is closed, a vacuum is created in the container and leakage caused by accidental spills may be substantially reduced.

For storage of carbonated beverages, a closure, e.g. cap 40 (FIG. 2) which may be attached to the lid 12, may be provided for the straw to prevent a fountain effect of fluid flowing out of the straw should the container be upset or jarred, and also to keep the contents from going flat.

Other embodiments are within the following claims.

What is claimed is:

1. A fluid containment and access device for use with a beverage container having an upper, beaded rim and an opening for flow of the fluid contents from within the volume of the container, said device comprising:

a flexible lid sized and constructed for secure fit upon the top of the beverage container in a manner to form a fluid-tight seal thereupon;

a straw integral with an fixedly joined to said lid, said straw having a first end extending generally above said lid and a second end adapted to extend through the opening into the volume of the container, said straw being sized to extend substantially to the bottom of the beverage container, said first end of said straw being angled approximately 45° to a vertical axis of the container, and said second end of said straw comprising a middle portion disposed generally vertical to the container axis, and a lower portion angled at approximately 45° to the container axis and extending substantially to the bottom rim of said container; and a vent assembly mounted in said lid, said vent assembly comprising a closure element adapted to be moved between a first position to permit the flow of air into the beverage container and a second position to prevent the flow of air into the beverage container.

2. The fluid containment and access device of claim 1 wherein the container further has a lower rim defined at the intersection of the container side wall and base, and said second end of said straw is sized and constructed to engage the lower rim of said container in a region directly below the container opening.

3. The fluid containment and access device of claim 1 wherein, in said first position, said closure assembly is adapted to be pulled up and away from said lid, and in said second position, said closure assembly is adapted to be pushed down and towards said lid.

4. The fluid containment and access device of claim 1 wherein said device further comprises a closure element for said straw.

5. The fluid containment and access device of claim 4 wherein said closure element for said straw comprises a cap.

* * * * *